US011678126B1

(12) United States Patent
Venkatakrishnan et al.

(10) Patent No.: US 11,678,126 B1
(45) Date of Patent: Jun. 13, 2023

(54) HEARING DEVICE SEAL MODULES, MODULAR HEARING DEVICES INCLUDING THE SAME AND ASSOCIATED METHODS

(71) Applicant: Sonova AG, Stäfa (CH)

(72) Inventors: Yashvant Venkatakrishnan, San Jose, CA (US); Xiuming Zhu, San Jose, CA (US); Grace Gardner, San Leandro, CA (US); Marius Rüfenacht, Volketswil (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/547,175

(22) Filed: Dec. 9, 2021

(51) Int. Cl.
*H04R 25/00* (2006.01)
*H04R 31/00* (2006.01)

(52) U.S. Cl.
CPC ..... *H04R 25/456* (2013.01); *H04R 31/00* (2013.01); *H04R 2225/023* (2013.01); *H04R 2460/15* (2013.01)

(58) Field of Classification Search
CPC ..... H04R 25/456; H04R 2225/023; H04R 2460/15
See application file for complete search history.

(56) References Cited

U.S. PATENT DOCUMENTS 4,870,688 A 9/1989 Voroba et al.
4,880,076 A 11/1989 Ahlberg et al.
5,002,151 A 3/1991 Oliveira et al.
5,250,926 A * 10/1993 McSwiggen ..... H01C 1/024 338/164
6,129,174 A 10/2000 Brown et al.
6,940,988 B1 9/2005 Shennib et al.
7,215,789 B2 5/2007 Shennib et al.
7,580,537 B2 8/2009 Urso et al.
7,664,282 B2 2/2010 Urso et al.
7,864,972 B2 1/2011 Mcintosh et al.
8,184,842 B2 5/2012 Howard et al.
8,467,556 B2 6/2013 Shennib et al.
8,477,978 B2 7/2013 Caldarola
8,682,016 B2 3/2014 Wagner et al.
8,693,719 B2 4/2014 Higgins
8,761,423 B2 6/2014 Wagner et al.
(Continued)

FOREIGN PATENT DOCUMENTS

GB 2203379 A 10/1988
WO WO 2019103748 A1 5/2019

OTHER PUBLICATIONS

U.S. Appl. No. 16/140,322, filed Sep. 24, 2018, U.S. Pat. No. 10,701,497.
(Continued)

*Primary Examiner* — Suhan Ni
(74) *Attorney, Agent, or Firm* — Henricks Slavin LLP

(57) ABSTRACT

A hearing device seal module in accordance with at least one of the present inventions includes a tubular seal carrier defining a lumen configured to receive a hearing device core and including a connector region and a resilient seal support region formed from resilient material, a seal carrier support connected to the seal carrier connector region of the tubular seal carrier, including a support tube defining a longitudinal axis and a lumen configured to permit movement of the hearing device core and a tool along the longitudinal axis, and having an open state and a closed state.

20 Claims, 11 Drawing Sheets

(56) References Cited

U.S. PATENT DOCUMENTS

| | | | |
|---|---|---|---|
| 8,848,956 | B2 | 9/2014 | Higgins et al. |
| 10,582,320 | B2 | 3/2020 | Wagner et al. |
| 10,701,497 | B2 | 6/2020 | Chana et al. |
| 11,336,982 | B1 | 5/2022 | Ventatakrishnan et al. |
| 2005/0123163 | A1 | 6/2005 | Oliveira et al. |
| 2009/0074220 | A1 | 3/2009 | Shennib |
| 2009/0202097 | A1 | 8/2009 | Tiscareno et al. |
| 2013/0051590 | A1 | 2/2013 | Slater |
| 2014/0010396 | A1 | 1/2014 | Karamuk et al. |
| 2015/0382094 | A1 | 12/2015 | Grinker et al. |
| 2018/0167716 | A1* | 6/2018 | Fujimoto ..... G01J 1/0204 |
| 2019/0349696 | A1 | 11/2019 | Meier et al. |
| 2020/0100037 | A1 | 3/2020 | Chana et al. |
| 2020/0296527 | A1 | 9/2020 | Wagner et al. |

OTHER PUBLICATIONS

U.S. Appl. No. 17/134,290, filed Dec. 26, 2020, U.S. Pat. No. 11,336,982.

* cited by examiner

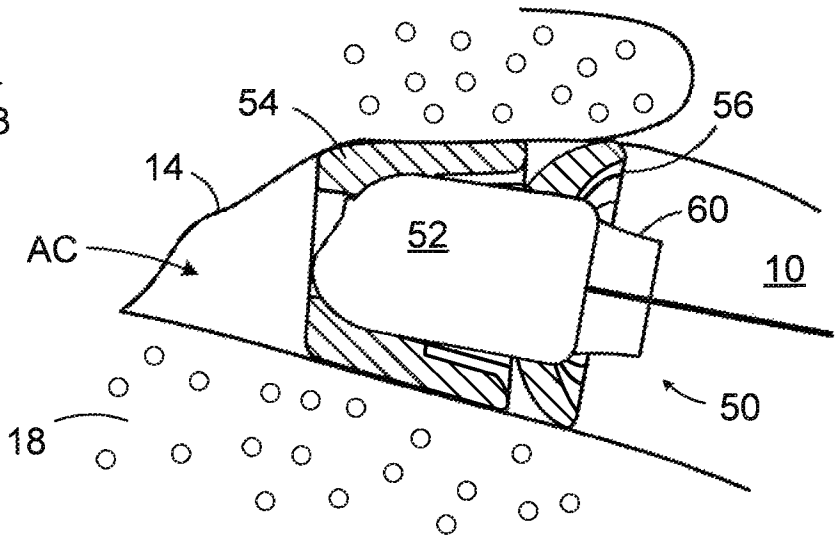
FIG. 4 - Prior Art
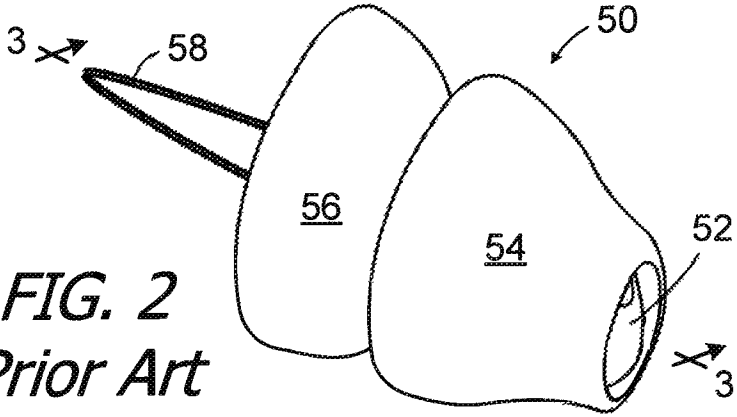
FIG. 2
Prior Art
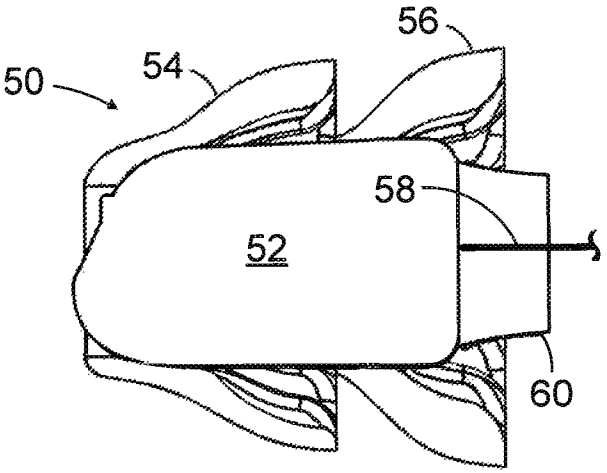
FIG. 3 - Prior Art

HEARING DEVICE SEAL MODULES, MODULAR HEARING DEVICES INCLUDING THE SAME AND ASSOCIATED METHODS

BACKGROUND

1. Field

The present inventions relate generally to hearing devices and, for example, hearing devices that are worn in the ear canal.

2. Description of the Related Art

Referring to the coronal view illustrated in FIG. 1, the adult ear canal 10 extends from the canal aperture 12 to the tympanic membrane (or "eardrum") 14, and includes a lateral cartilaginous region 16 and a bony region 18 which are separated by the bony-cartilaginous junction 20. Debris 22 and hair 24 in the ear canal are primarily present in the cartilaginous region 16. The concha cavity 26 and auricle 28 are located lateral of the ear canal 10, and the junction between the concha cavity 26 and cartilaginous region 16 of the ear canal at the aperture 12 is also defined by a characteristic bend 30, which is known as the first bend of the ear canal.

Extended wear hearing devices are configured to be worn continuously, from several weeks to several months, inside the ear canal. Some extended wear hearing devices are configured to rest entirely within the bony region and, in some instances, within 4 mm of the tympanic membrane. Examples of extended wear hearing devices are disclosed in U.S. Patent Pub. No. 2009/0074220, U.S. Pat. No. 7,664,282 and U.S. Pat. No. 8,682,016, each of which is incorporated herein by reference. Referring to FIGS. 2 and 3, the exemplary hearing device 50 includes a core 52, medial and lateral seal retainers (or "seals") 54 and 56, and a removal loop 58. A contamination guard 60 with a screen (not shown) abuts the microphone. The core 52 includes a housing as well as a battery, a microphone, a receiver, and control circuity located within the housing. The seals 54 and 56 suspend and retain the hearing device core 52 within the ear canal and also suppress sound transmission and feedback which can occur when there is acoustic leakage between the receiver and microphone. The seals 54 and 56 are frequently formed from a highly porous and highly compliant foam material (e.g., hydrophilic polyurethane foam), which conforms to the ear canal geometry by deflection and compression, as is illustrated in FIG. 4. The seals 54 and 56 are glued or otherwise permanently secured to the core 52 at the manufacturing site. An air cavity AC is defined between the tympanic membrane 14 and medial end of the hearing device 50.

It is especially important that the seals be properly sized for the intended ear canal. An extended wear hearing device with improperly sized seals may result in a less than optimal insertion depth within the ear canal and/or gaps and folds in the seal. Less than optimal insertion depth and/or a poor seal/ear canal interface may result in, for example, discomfort, injury to the ear canal, and inadequate acoustic feedback suppression. Given the fact that hearing devices are placed in ear canals of varying shapes and sizes, hearing device manufactures typically manufacture hearing devices with a variety of seal sizes. For example, a particular hearing device may be manufactured with any of seven different seal sizes (i.e., XXS, XS, S, M, L, XL and XXL), or combinations of sizes. The hearing device seal size is typically determined during the fitting process and the patient is provided with a pre-sized hearing device with appropriately sized seals.

The present inventors have determined that there are a number of shortcomings associated with conventional methods of assembling hearing devices. For example, because the seals are glued or otherwise permanently secured to the core at the manufacturing site, fitting facilities must stock a large number of hearing devices in order to ensure that they have an appropriately sized hearing device for each patient. The carrying costs of maintaining a wide variety of sizes can be quite high, especially given the fact that some of the hearing devices will expire while in storage (due to battery lifetime).

Permanently securing the seals to the core at the manufacturing site also eliminates the ability of the fitting facility to provide customized seal combinations such as, for example, a lateral seal that is larger than a medial seal in a so-called conical arrangement. It should also be noted that various mechanical interconnects such as locking mechanisms and threaded connectors have been proposed for connecting seals to hearing device cores, especially in the context of receiver in the canal ("RIC") hearing devices. The present inventors have determined that such interconnects can be difficult to use given the small size of the RIC hearing devices, and are nevertheless too large to be used on completely in the canal ("CIC") hearing devices.

SUMMARY

A hearing device seal module in accordance with at least one of the present inventions includes a tubular seal carrier defining a lumen configured to receive a hearing device core and including a connector region and a resilient seal support region formed from resilient material, a seal carrier support connected to the seal carrier connector region of the tubular seal carrier, including a support tube defining a longitudinal axis and a lumen configured to permit movement of the hearing device core and a tool along the longitudinal axis, and having an open state wherein the tool is able to move out of the lumen in a direction transverse to the longitudinal axis and a closed state wherein the tool is not able to move out of the lumen in a direction transverse to the longitudinal axis, and a first seal secured to a first portion of the seal support region and extending outwardly therefrom. The present inventions also include systems with a hearing device core and/or a tool (e.g., a forceps) in combination with a plurality of such hearing device seal modules with respective different seal configurations.

A method in accordance with at least one of the present inventions includes securing a hearing device core to a tool, forming a hearing device by positioning a seal on the hearing device core with a hearing device seal module while the hearing device core is secured to the tool and in such a manner that a spent hearing device seal module remains on the tool after the hearing device is formed and, without separating the hearing device from the tool, separating the spent hearing device seal module from the tool.

There are a variety of advantages associated with the present hearing device seal modules and methods. For example, the present hearing device seal modules and methods allow fitting facilities to secure appropriately sized seals onto hearing device cores at the time of fitting by simply pushing the core into the seal module to form a hearing device. This allows the assembly process to be performed quickly in an easily repeatable manner. The seals may also be removed and replaced if necessary based on, for example, patient feedback. A wide variety of seal sizes may be stored (as portions of seal modules) at the fitting facility, including rarely used sizes and differently sized seals on the same module, because the seals (and the present seal modules) are relatively inexpensive and are unlikely to expire prior to use. As such, the present hearing device seal modules and associated methods allow fitting facilities to store an appropriate number of hearing device cores, based on the expected number of patients and without regard to seal size, thereby reducing carrying costs and waste due to core expiration.

The present hearing device seal modules and methods also allow the tool that was used to push the core into the seal module to thereafter insert the completed hearing device into the recipient's ear. As such, the completed hearing device does not have to be separated from the tool or directly handled in any way prior to being inserted, thereby simplifying the process and decreasing the likelihood of seal contamination which can lead to ear health issues.

The many other features of the present inventions will become apparent as the inventions become better understood by reference to the following detailed description when considered in conjunction with the accompanying drawings.

BRIEF DESCRIPTION OF THE DRAWINGS

Detailed descriptions of the exemplary embodiments will be made with reference to the accompanying drawings.

FIG. 2 is a perspective view of a conventional hearing device.

FIG. 3 is a partial section view taken along line 3-3 in FIG. 2.

FIG. 4 is a partial section view showing the hearing device illustrated in FIGS. 2 and 3 within the ear canal.

DETAILED DESCRIPTION OF EXEMPLARY EMBODIMENTS

Figure 1:
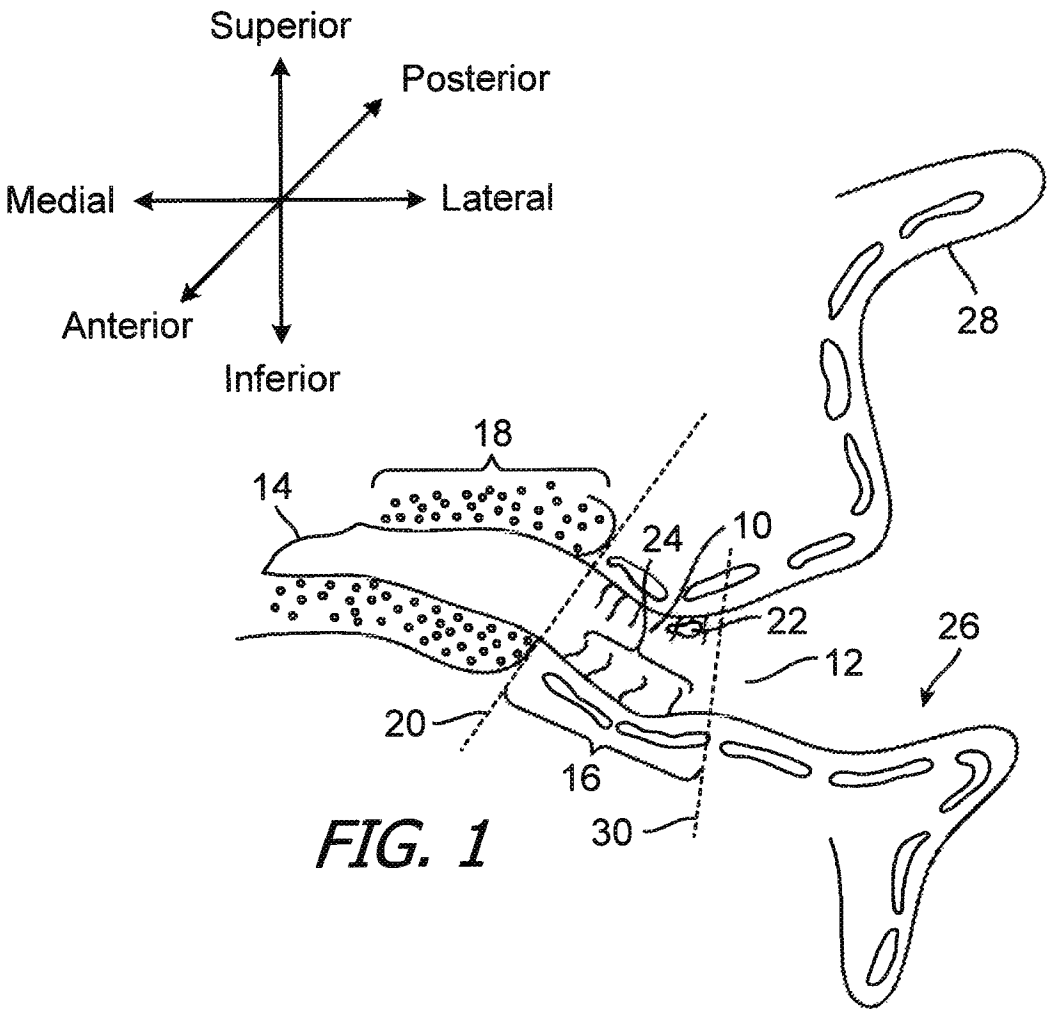
FIG. 1 is a section view showing the anatomical features of the ear and ear canal.

The following is a detailed description of the best presently known modes of carrying out the inventions. This description is not to be taken in a limiting sense, but is made merely for the purpose of illustrating the general principles of the inventions. Referring to FIG. 1, it should also be noted that as used herein, the term "lateral" refers to the direction and parts of hearing devices which face away from the tympanic membrane when within an ear canal, the term "medial" refers to the direction and parts of hearing devices which face toward the tympanic membrane when within an ear canal, the term "superior" refers to the direction and parts of hearing devices which face the top of the head when within an ear canal, the term "inferior" refers to the direction and parts of hearing devices which face the feet when within an ear canal, the term "anterior" refers to the direction and parts of hearing devices which face the front of the body when within an ear canal, and the "posterior" refers to the direction and parts of hearing devices which face the rear of the body when within an ear canal.

Figure 6:
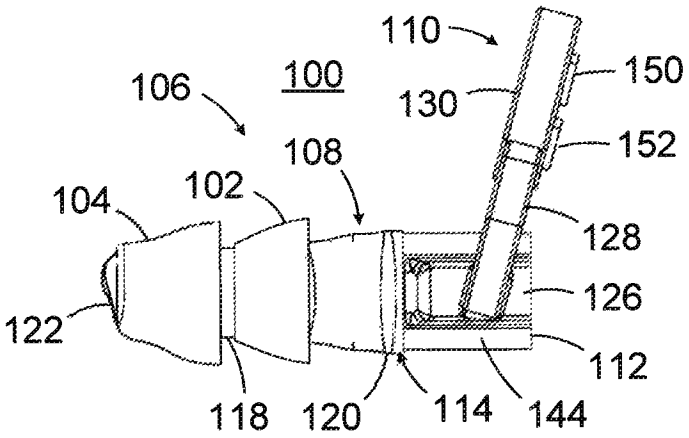
FIG. 6 is side view of the hearing device seal module illustrated in FIG. 5.
Figure 5:
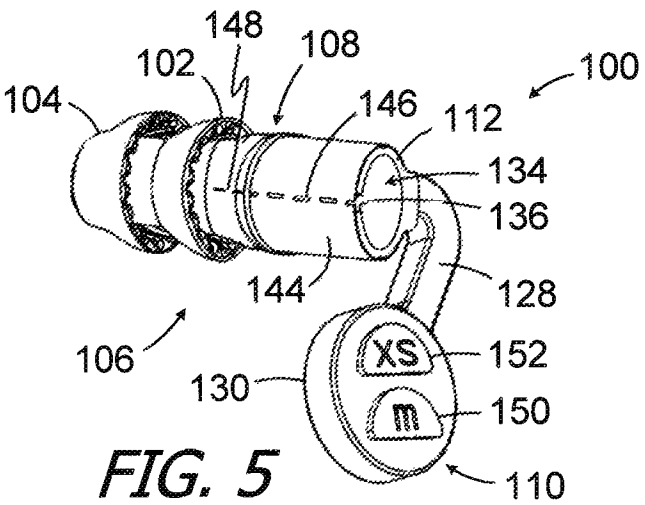
FIG. 5 is a perspective view of a hearing device seal module in accordance with one embodiment of a present invention.
Figure 7:
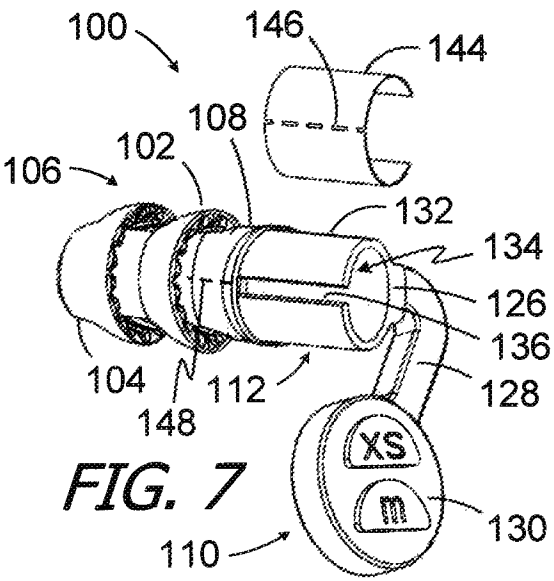
FIG. 7 is an exploded perspective view of the hearing device seal module illustrated in FIG. 5.

As illustrated in FIGS. 5-7, an exemplary hearing device seal module 100 in accordance with one embodiment of a present invention includes seals 102 and 104 and an assembly apparatus 106 that may be used both to position the seals onto a hearing device core (or "core") and to secure the seals to the hearing device core. The seals 102 and 104 may be secured to the assembly apparatus 106 through the use of adhesive or any other suitable instrumentality. In at least some instances, the assembly apparatus 106 will semi-permanently secure the seals to the hearing device core. As used herein, seals that are "semi-permanently secured" to the hearing device core are seals that will remain secured to the core under expected use conditions and that can be removed from the core without damage to the core if so desired. For example, should it be determined during fitting that the seals 102 and 104 are not the most optimal size, the seals may be removed from the core and replaced with seals from another seal module 100.

Although the present modules are not limited to any particular type of hearing device seal, the exemplary seals 102 and 104 are the same as those commonly employed on extended wear hearing devices and, accordingly, are configured to substantially conform to the shape of walls of the ear canal, maintain an acoustical seal between a seal surface and the ear canal, and retain the hearing device core securely within the ear canal. Additional information concerning the specifics of exemplary seals may be found in U.S. Pat. No. 7,580,537, which is incorporated herein by reference. With respect to materials, the seals 102 and 104 be formed from compliant material configured to conform to the shape of the ear canal. Suitable materials include elastomeric foams having compliance properties (and dimensions) configured to conform to the shape of the intended portion of the ear canal (e.g., the bony portion) and exert a spring force on the ear canal so as to hold the core in place in the ear canal. Exemplary foams, both open cell and closed cell, include but are not limited to foams formed from polyurethanes, silicones, polyethylenes, fluoropolymers and copolymers thereof. Hydrophilic polyurethane foam is one specific example.

The exemplary assembly apparatus 106 illustrated in FIGS. 5-10C includes a tubular seal carrier 108, a handle 110, and a seal carrier support 112 within at least a portion of the tubular seal carrier. The seal carrier support 112 may, for example, be configured to hold the tubular seal carrier 108 open before and during insertion of the hearing device core. The seal carrier 108, which is discussed in greater detail below with reference to FIGS. 15-18, has an outer wall 114 that defines an internal lumen 116 (FIG. 9), a seal support region 118, and a connector region 120 that extends from the seal support region to the seal carrier support 112. The medial end of the seal carrier 108 has a sound aperture 122. A weakened area 124, defined for example by a score line, spaced perforations or one or more slits, facilitates separation of the seal support region 118 from the connector region 120 after the seal support region secures the seals 102 and 104 to a hearing device core in, for example, the manner described below with reference to FIGS. 19A-26.

The exemplary handle 110 includes a base 126 that is secured to the seal carrier support 112, an arm 128, and finger grip 130. The finger grip 130 may include indicia representative of the sizes of the seals 102 and 104, as is discussed in greater detail below.

Figure 10A:
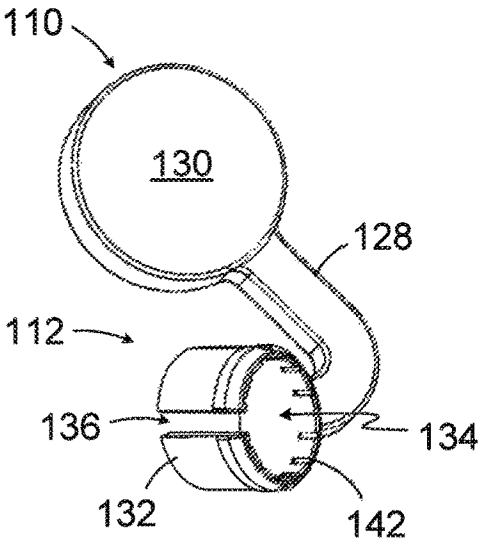
FIG. 10A is a perspective view of a portion of the hearing device seal module illustrated in FIG. 5.
Figure 10C:
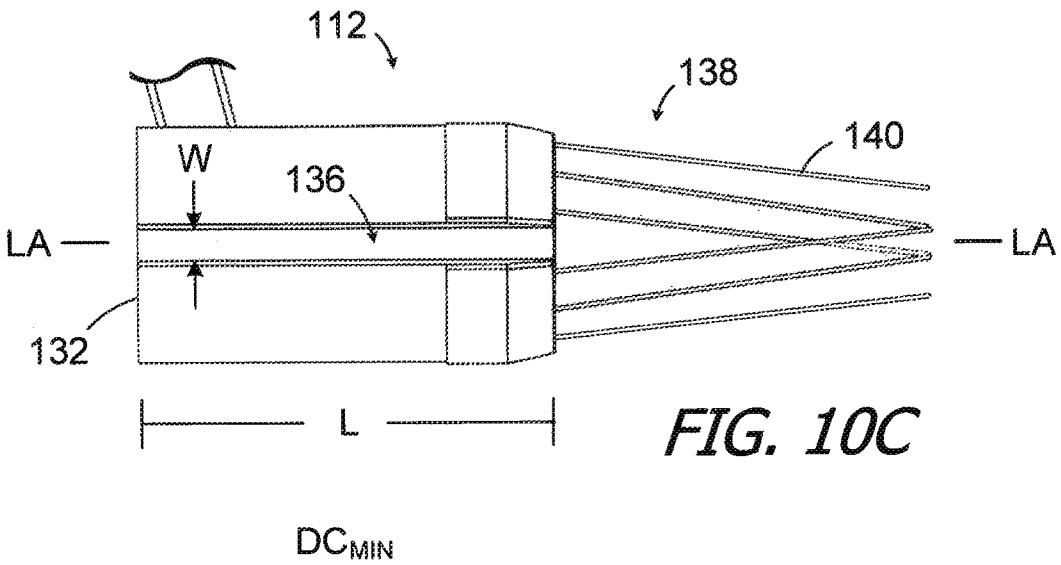
FIG. 10C is a side view of a portion of the hearing device seal module illustrated in FIG. 5.
Figure 10B:
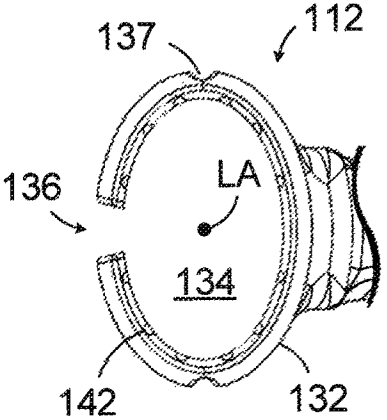
FIG. 10B is a perspective view of a portion of the hearing device seal module illustrated in FIG. 5.

Referring more specifically to FIGS. 10A-10C, the exemplary seal carrier support 112 includes a support tube 132 with an internal lumen 134 that may have an oval shape corresponding to the oval shape of the associated hearing device core to facilitate proper orientation of the core during assembly of the hearing device. Other shapes may also be employed as necessary to accommodate the shape of other hearing device cores. A tool slot 136, which allows the seal carrier support 112 to be separated from the forceps (or other tool) used during the hearing device assembly process in the manner described below with reference to FIGS. 19A-26, extends through the support tube 132 from one longitudinal end of the support tube to the other. The tool slot 136 has a length L (FIG. 10C) and a width W. The support tube 132 may be provided with weakened areas 137 that function as hinges and facilitate pivoting of portions of the support tube that results in the tool slot 136 increasing in width to a point at which a tool within the lumen 134 can pass through the tool slot. Put another way, the support tube 132 has a closed state (FIG. 10B) where the support tube cannot be detached from a tool within the lumen 134 and an open state where the support tube can be detached from a tool within the lumen 134 (e.g., by passing through the tool slot 136).

Figure 8:
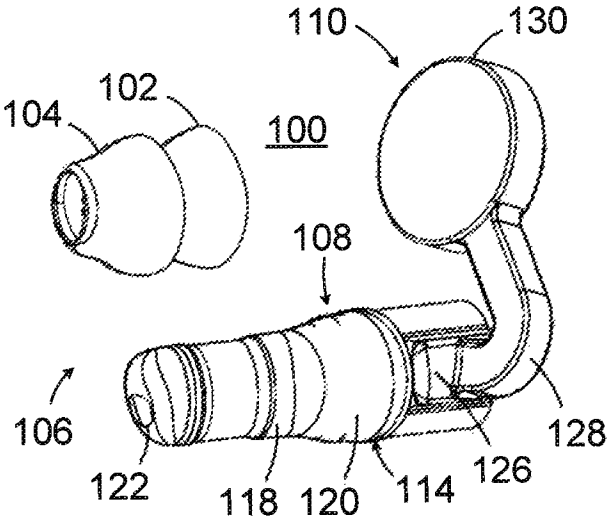
FIG. 8 is an exploded perspective view of the hearing device seal module illustrated in FIG. 5.
Figure 9:
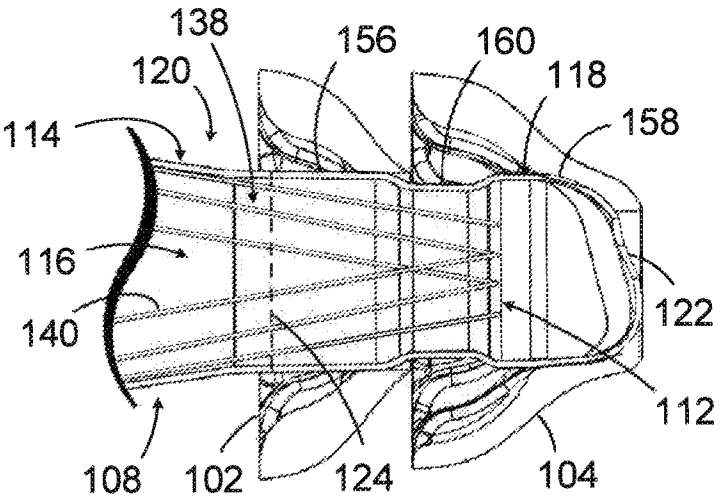
FIG. 9 is a section view of a portion of the hearing device seal module illustrated in FIG. 5.

The seal carrier support 112 holds the seal carrier 108 open, thereby preventing it from collapsing, as a hearing device core passes through the seal carrier during the assembly process described below with reference to FIGS. 19A-26. The seal carrier support 112 may also act as a guide to properly orient the hearing device core relative to the seal carrier 108, and may reduce the friction forces acting on the core as it moves within the seal carrier. The exemplary seal carrier support 112 extends at least from the support tube 132 to the seal support region 118 of the seal carrier 108, as shown in FIGS. 7-9. The seal carrier support 112 includes a tapered, generally conical portion 138 with a shape corresponding to the connector region 120 of the seal carrier 108. In the illustrated implementation, the seal carrier support 112 includes a plurality of elongate members 140 that extend into the tubular seal carrier 108 past the weakened area 124 and the lateral seal 102 to a location within the seal support region 118 that is aligned with medial seal 104. The conical portion 138 is defined by the elongate members. The seal carrier support 112 in the illustrated implementation will also be separated from the seal support region 118 of the seal carrier 108 after the hearing device core has reached the medial end of the seal carrier as is described below with reference to FIG. 23.

Suitable materials for the exemplary handle 110 and seal carrier support 112 include, but are not limited to, polypropylene, polyoxymethylene (POM) and polylactic acid (PLA). The elongate members 140 are in the form of wires in the illustrated embodiment. Suitable wire materials include, but are not limited to, stainless steel or PTFE-coated stainless steel. The elongate members 140 may also be filaments and molded bristles formed from materials such as Nylon or PTFE. It also should be noted, however, that any suitable structure(s), or combinations of structures, may be used to form the seal carrier support 112. By way of example, but not limitation, a lubricious tube may be positioned within the seal carrier 108 in place of, or in addition to, the elongate members 140.

The interior surface of the exemplary support tube 132 may include a plurality of indentations 142 for the lateral ends of the elongate members 140. Although the present inventions are not so limited, each indentation 142 is capable of receiving a portion of one of the elongate members 140. The elongate members 140 may be secured to the indentations 142 with adhesive or another suitable method. Depending on the implementation, the respective number of elongate members 140 and indentations 142 may be the same or there may be more indentations than elongate members. The elongate members 140 may be evenly distributed in the indentations 142 or unevenly distributed. For example, there may be more elongate members 140 near the smaller radius regions at the ends of the major diameter of the oval seal carrier support 112. In at least one implementation, there may be twelve elongate members 140 and twelve indentations 142. The connector region 120 of the seal carrier 108 is also mounted on and secured to the support tube 132 (FIG. 7) with adhesive or another suitable instrumentality.

Figure 25A:
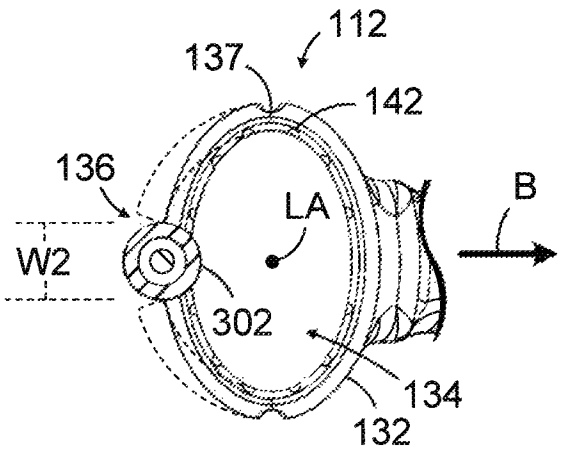
FIG. 25A is a side, partial section view showing a portion of a method in accordance with one embodiment of a present invention.
Figure 24:
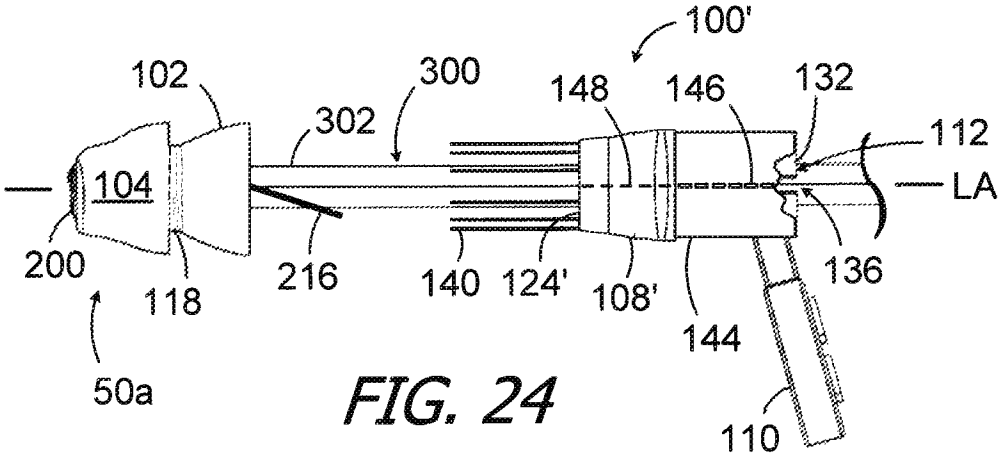
FIG. 24 is a side, cutaway view showing a portion of a method in accordance with one embodiment of a present invention.
Figure 25B:
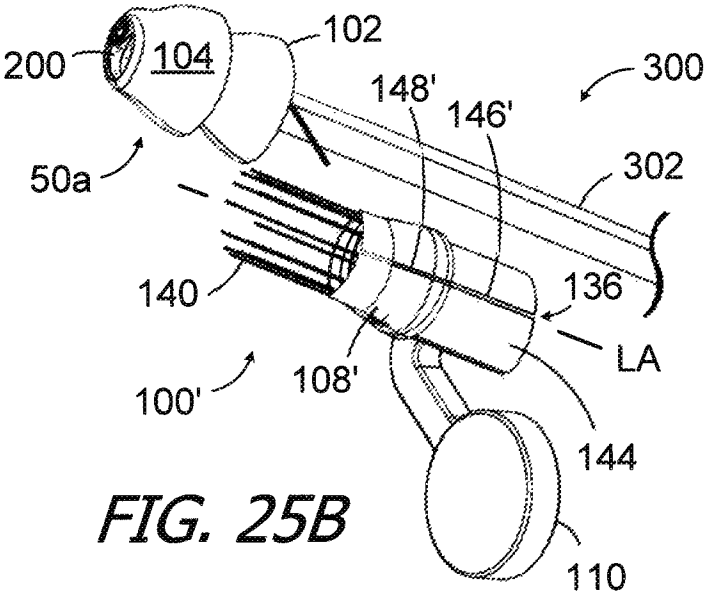
FIG. 25B is a perspective view showing a portion of a method in accordance with one embodiment of a present invention.

As illustrated for example in FIGS. 5 and 7, a sleeve 144 that is mounted on the support tube 132 may be provided to cover the tool slot 136 that extends through the support tube 132 to prevent the seal module 100 from inadvertently separating from the associated forceps (or other tool) by way of the tool slot. However, removal of the seal carrier support 112 after the seals 102 and 104 have been mounted on a hearing device core in the manner described below with reference to FIGS. 24-25B is facilitated by a weakened area 146 that is over the tool slot 136. The weakened area 146, which may be a series of spaced perforations (as shown), a score line or one or more slits, will break when the support tube 132 in the manner described below with reference to FIGS. 25A and 25B. A weakened area 148 is also provided on the portion of the tubular seal carrier 108 that will remain attached to the support tube 132 after the seals 102 and 104 have been mounted.

One advantage associated with the present hearing device seal modules and methods is that they allow fitting facilities to store seal modules with a variety seal sizes, or size combinations, and to deploy them as needed. At the time of fitting, the module with the appropriately sized seals may be used to secure the seals to the core. Referring to FIGS. 5-7, and as alluded to above, the finger grip 130 may include indicia 150 and 152 that are respectively representative of the sizes of the seal 102 and seal 104. Such sizes may be, for example, XXS, XS, S, M, L, XL and XXL.

Figure 11E:
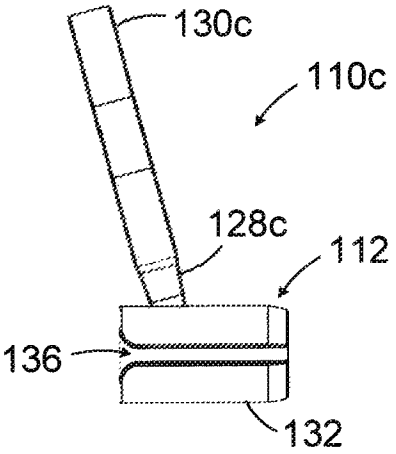
FIG. 11E is a side view of a portion of a hearing device seal module in accordance with one embodiment of a present invention.
Figure 11F:
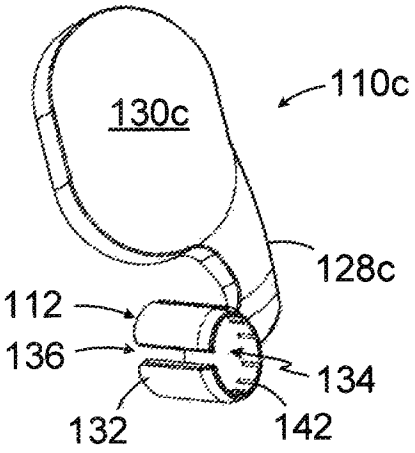
FIG. 11F is a perspective view of the portion of a hearing device seal module illustrated in FIG. 11E.
Figure 11C:
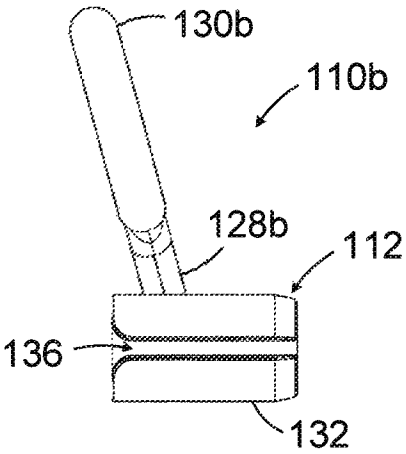
FIG. 11C is a side view of a portion of a hearing device seal module in accordance with one embodiment of a present invention.
Figure 11D:
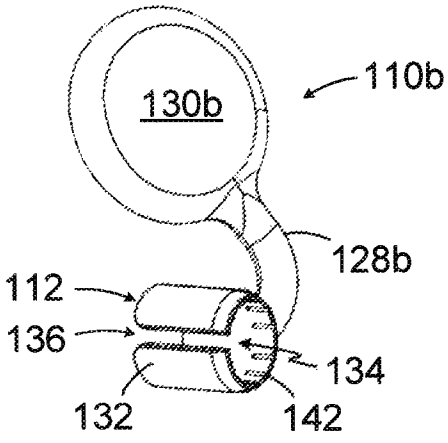
FIG. 11D is a perspective view of the portion of a hearing device seal module illustrated in FIG. 11C.
Figure 11A:
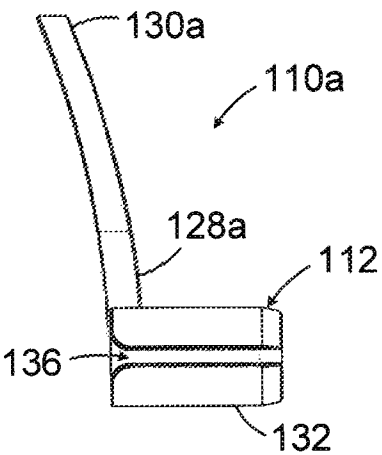
FIG. 11A is a side view of a portion of a hearing device seal module in accordance with one embodiment of a present invention.
Figure 11B:
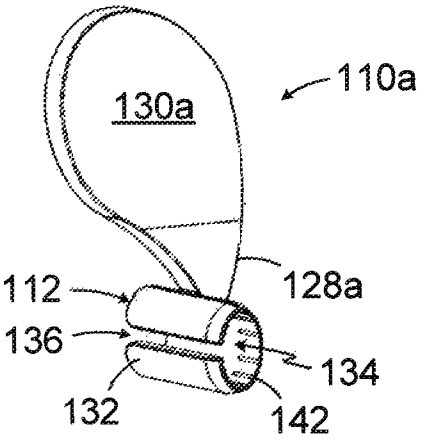
FIG. 11B is a perspective view of the portion of a hearing device seal module illustrated in FIG. 11A.

It should be noted here that the assembly apparatus 106 may be modified in a variety of ways. By way of example, but not limitation, the configuration of the handle 110 may be modified to adjust the ergonomic and aesthetic aspects of the seal module 100. The exemplary handle 110*a* illustrated in FIGS. 11A and 11B includes an arm 128*a* and a finger grip 130*a* that together define a bowed teardrop shape. The arm 128*b* and finger grip 130*b* of the exemplary handle 110*b* illustrated in FIGS. 11C and 11D have smoother curves, as compared to the arm 128 and finger grip 130. The exemplary handle 110*c* illustrated in FIGS. 11E and 11F includes an arm 128*c* that is wider than arm 128 and a finger grip 130*c* that is oval in shape and larger than the finger grip 130.

Other variations may be associated with the seal carrier support 112. By way of example, but not limitation, the locations of one or both of the handle 110 and the tool slot 136 on the support tube 132 may be adjusted. The location of the weakened area 137 on the support tube 132 and the weakened area 146 of the sleeve 144 would also be adjusted accordingly. For example, and referring to FIG. 7, the location of the tool slot 136 may be offset by 90 degrees from the illustrated location. Alternatively, or in addition, the handle base 126 may be offset by 90 degrees from the location illustrated in FIG. 7. Alternatively, or in addition, an instrumentality other than the perforated sleeve 144 (such as a latch) may be used to cover the tool slot 136 to prevent the seal module 100 from inadvertently separating from the associated tool. The tool slot may also be eliminated and the support tube may be configured to simply come apart when being removed from the tool. For example, the support tube may be a two part structure held together with magnets when the support tube is in a closed state and separated from one another when the support tube is in an open state.

Figure 12:
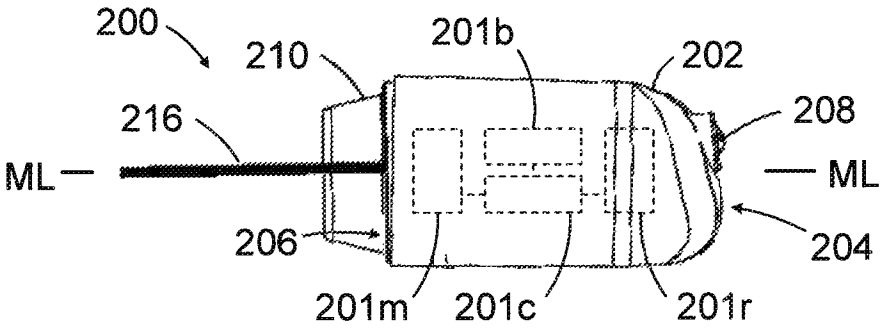
FIG. 12 is a side view of a hearing device core.
Figure 13:
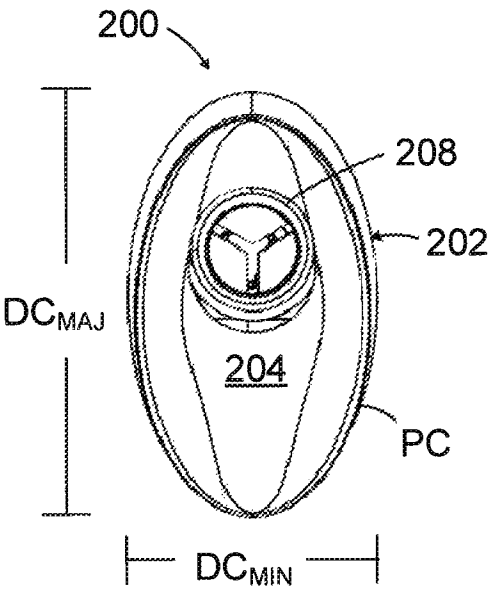
FIG. 13 is an end view of the hearing device core illustrated in FIG. 12.
Figure 14:
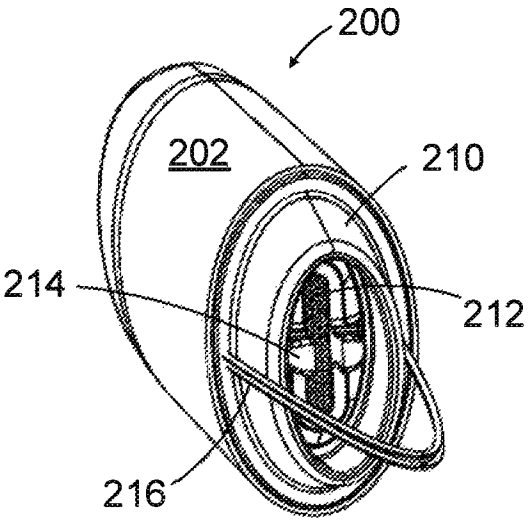
FIG. 14 is a perspective view of the hearing device core illustrated in FIG. 12.
Figure 15:
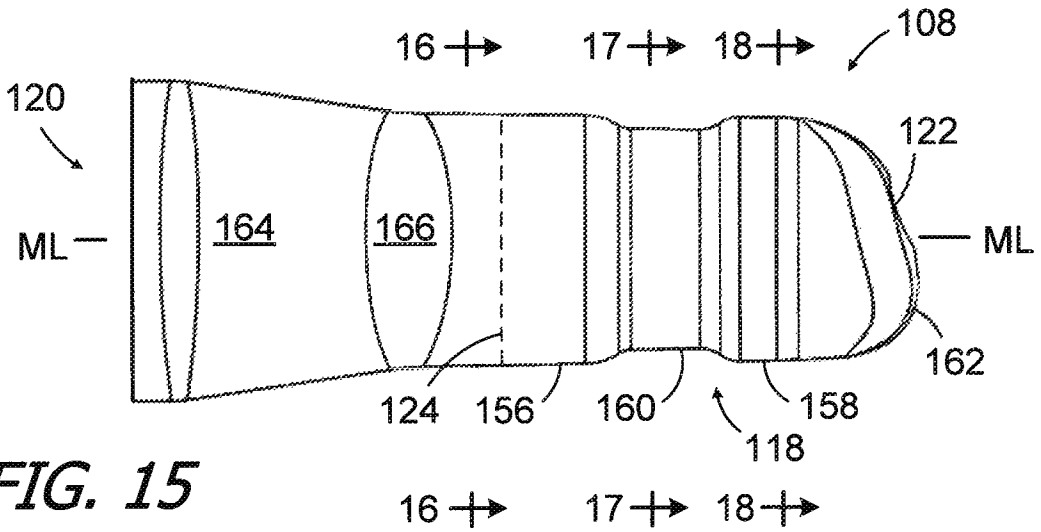
FIG. 15 is a side view of a portion of the hearing device seal module illustrated in FIG. 5.
Figure 18:
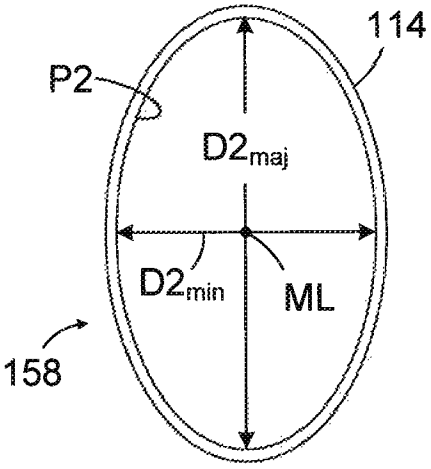
FIG. 18 is a section view taken along line 18-18 in FIG. 15.
Figure 17:
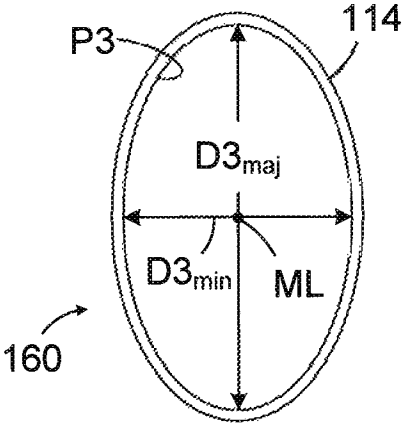
FIG. 17 is a section view taken along line 17-17 in FIG. 15.
Figure 16:
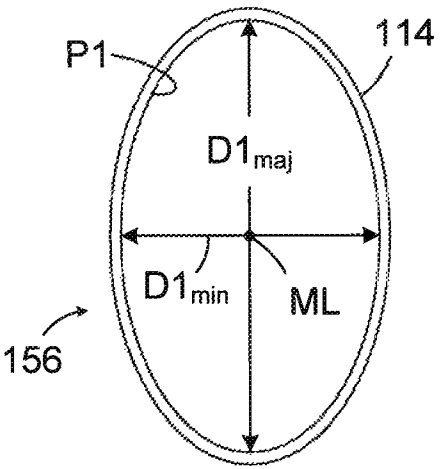
FIG. 16 is a section view taken along line 16-16 in FIG. 15.

One example of a hearing device core is the core 200 illustrated in FIGS. 12-14. The exemplary core 200 includes a housing 202, with medial and lateral ends 204 and 206 and a receiver port 208, a contamination guard 210 with a screen 212, a pair of tabs 214 that may be used during insertion and removal of a hearing device into the ear, and a removal loop 216. The exemplary core 200 also includes a battery 201*b*, a microphone 201*m*, a receiver 201*r*, and control circuity 201*c* that are operably connected to one another and are located within the housing 202. Exemplary hearing device cores are illustrated and described in, for example, U.S. Pat. No. 8,761,423, which is incorporated herein by reference. The present inventions are not, however, limited to any particular type of hearing device core.

Although the present cores are not limited to any particular shapes, the exemplary hearing device core 200 illustrated in FIGS. 12-14 has an oval shape (e.g., an elliptical or at least substantially elliptical shape), defined by the outer surface of the housing 202, in planes perpendicular to the medial-lateral axis ML that extends through the center of the hearing device. The oval shape defines a major dimension $DC_{MAJ}$, a minor dimension $DC_{MIN}$, and an outer perimeter PC. These dimension taper (or "decrease") slightly in the lateral to medial direction in the exemplary implementation. Additionally, the receiver port 208 is not centered on the medial-lateral axis ML. Put another way, the housing 202 and the receiver port 208 are not coaxial.

Turning to FIGS. 15-18, the exemplary hearing device seal module 100 is configured to create an interference fit with the associated hearing device core 200 and, given that the seals 102 and 104 are part of the seal module, secure the seals to the core. In particular, the seal support region 118 of the exemplary seal carrier 108 is configured to create an interference fit with the hearing device core 200. In at least some instances, the exemplary seal carrier 108 is configured to create an interference fit with the hearing device core 200 that will semi-permanently secure the seals 102 and 104 to the core so that the seals will remain secured to the core under expected use conditions and can be removed from the core, along with the associated portion of the seal carrier 108, without damage to the core.

In the embodiment illustrated in FIGS. 15-18, the seal support region 118 of the exemplary seal carrier 108, which is shown here in its unstretched (or "relaxed" or "unstressed") state, has a lateral portion 156, a medial portion 158, a central portion 160 located between the medial and lateral portions, and a medial end 162. Seal 102 may be secured to the lateral portion 156 of the support region 118, seal 104 may be secured to the medial portion 158 of the support region, and central portion 160 may be located between the seals, in the manner illustrated in FIG. 9. The connector region 120 has a lateral portion 164 that is secured to the handle 110 and a medial portion 166 that abuts the seal support region 118 at the weakened area 124.

The aforementioned interference fit is created when at least the central portion 160 resiliently stretches as the associated core 200 is pushed into the seal support region 118. As such, the respective dimensions of the seal carrier 108 and the associated hearing device core 200 are such that at least the central portion 160 is smaller than the portion of the associated core 200 that is aligned therewith when the core is fully inserted into the seal carrier 108, i.e., when the medial end 204 of the core housing 202 abuts the medial end 162 of the seal carrier seal support region 118. The material used to form the wall 114 of the seal carrier 108, or at least the seal support region 118 thereof, may be a relatively thin (e.g., 10-20 μm) material that is resilient and, in at least some embodiments, relatively tacky. Suitable materials include, but are not limited to, polyurethane and silicone.

One exemplary method (not shown) of securing one or more seals (e.g., seals 102 and 104) to the assembly apparatus 106 to form a hearing device seal module 100 involves supporting the tubular seal carrier 108 on a mandrel that has a contoured region at the medial end with a shape that corresponds to that of the seal support region medial end 162. The cross-sectional size and shape of the mandrel may correspond to that of the portion of the core 200 that will be aligned with the central portion 160 of the seal support region 118. As a result, when the mandrel is inserted into the seal carrier 108, the mandrel will stretch the seal support region central portion 160. The mandrel will also rest against the inner surface of the lateral portion 156 and medial portion 158. The seals 102 and 104 may then be positioned on the seal support region 118, and secured thereto with adhesive or any other suitable instrumentality. The mandrel may then be removed from the assembly apparatus seal carrier 108.

The seal support region 118 of the exemplary seal carrier 108 (which is shown in a relaxed, or unstressed, state in FIGS. 15-18) defines a shape, size and resilience that results in an interference fit with the associated hearing device core 200 when the core is in the seal support region 118. In particular, the shape, size and resilience of at least the central portion 160 will result in the resilient stretching (or "elastic deformation" or "a stressed state") of at least the central portion when the core is in the seal support region 118. In the illustrated implementation, the lateral portion 156, medial portion 158 and central portion 160 of the seal support region 118 each have an oval shape (e.g., an elliptical or at least substantially elliptical shape) in planes perpendicular to the medial-lateral axis ML that extends through the center of the seal carrier. The oval shapes defines respective major dimensions $D1_{MAJ}$, $D2_{MAJ}$ and $D3_{MAJ}$, respective minor dimensions $D1_{MIN}$, $D2_{MIN}$ and $D3_{MIN}$, and respective inner perimeters P1, P2 and P3. In the illustrated implementation, the inner perimeter P3 of the central portion 160 is smaller than the inner perimeters P1 and P2 of the lateral portion 156 and medial portion 158. Differences in inner perimeter size may be accomplished through differences in the major and/or minor dimensions and, in the illustrated embodiment, the differences in inner perimeter size may be accomplished through differences in both the major and minor dimensions. To that end, the major and minor dimensions $D3_{MAJ}$ and $D3_{MIN}$ of the central portion 160 are respectively less than the major and minor dimensions $D1_{MAJ}$ and $D1_{MIN}$ of the lateral portion 156 and are respectively less than the major and minor dimensions $D2_{MAJ}$ and $D2_{MIN}$ of the medial portion 158. The connector region 120 also has an oval shape.

Turning to the dimensional relationship between the exemplary seal carrier 108 and the hearing device core 200, and when core is fully inserted into the seal carrier (note FIG. 22), the inner perimeters P1 and P2 of the seal support region lateral and medial portions 156 and 158 are at least substantially equal in length (i.e., +/−1%) to the outer perimeter PC of the associated (i.e., aligned) portions of the core. The length of the inner perimeter P3 of the seal support region middle portion 160 less than (e.g., 7 to 10% less than) the outer perimeter PC of the associated portion of the core 200. Additionally, in the illustrated implementation, the major and minor dimensions $D3_{MAJ}$ and $D3_{MIN}$ of the seal support region central portion 160 are less than the respective major and minor dimensions $DC_{MAJ}$ and $DC_{MIN}$ of the associated portion of the core 200 (e.g., 7 to 10% less than), while the major and minor dimensions $DC_{MAJ}$ and $DC_{MIN}$ of the associated portions of the core are at least substantially equal to (i.e., +/−1%) the major and minor dimensions $D1_{MAJ}$ and $D1_{MIN}$ of the lateral portion 156 as well as the major and minor dimensions $D2_{MAJ}$ and $D2_{MIN}$ of the medial portion 158. It should also be noted that in those instances where the size of the core taper (or "decrease") slightly in the lateral to medial direction, seal support region 118 may taper correspondingly.

As noted above with reference to FIGS. 12-14, the receiver port 208 is not centered on the medial-lateral axis ML of the core 200. Additionally, the medial end 204 of the housing 202 has an inferior protrusion. The seal support region 118 in the illustrated embodiment may have a corresponding configuration. To that end, and referring to FIG. 22, the sound aperture 122 is also not centered on the medial-lateral axis ML and, as a result, the receiver port 208 will be aligned with the sound aperture 122 when the seal carrier 108 and hearing device core 200 are properly oriented relative to one another. The medial end 162 of the seal support region 118, which is closed but for the sound aperture, has an inferior protrusion.

The configuration of the exemplary hearing device seal module 100 allows a single insertion tool to be used to hold a hearing device core, such as the core 200, while the seals 102 and 104 are being mounted onto the hearing device core and to thereafter insert the completed hearing device into the recipient's ear. As a result, there is no need to move the completed hearing device from the tool used to mount the seals to a different tool that is used to insert the hearing device into the recipient's ear.

Figure 19A:
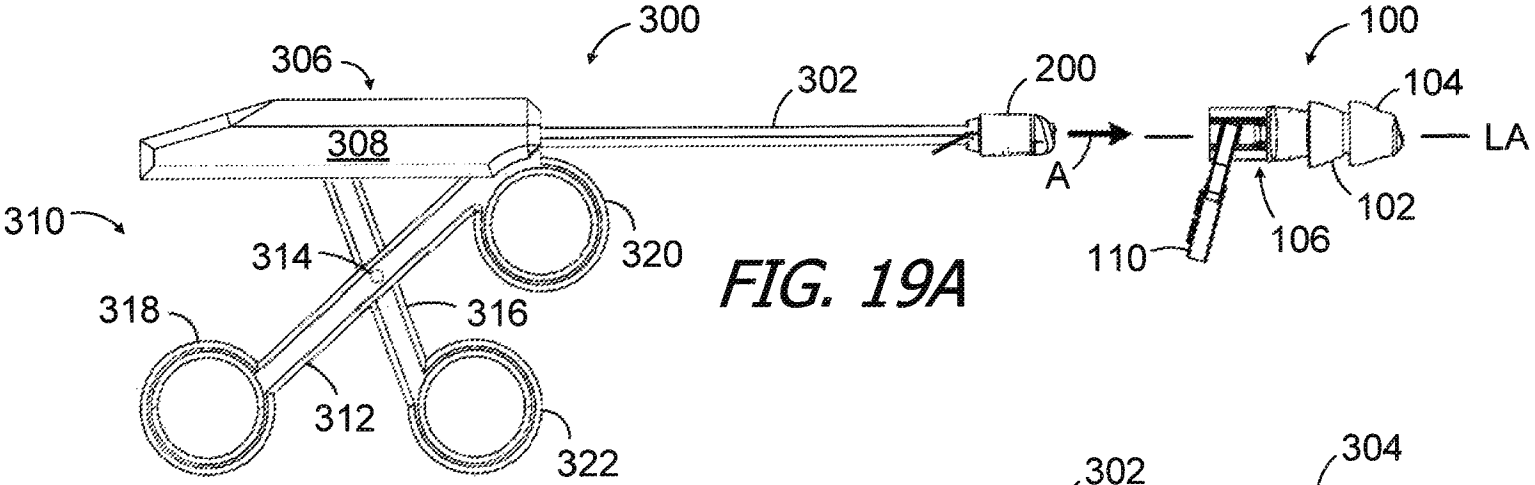
FIG. 19A is a side view showing a portion of a method in accordance with one embodiment of a present invention.
Figure 19B:
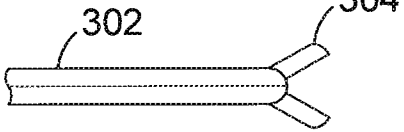
FIG. 19B is a side view of a portion of the tool illustrated in FIG. 19A.
Figure 20:
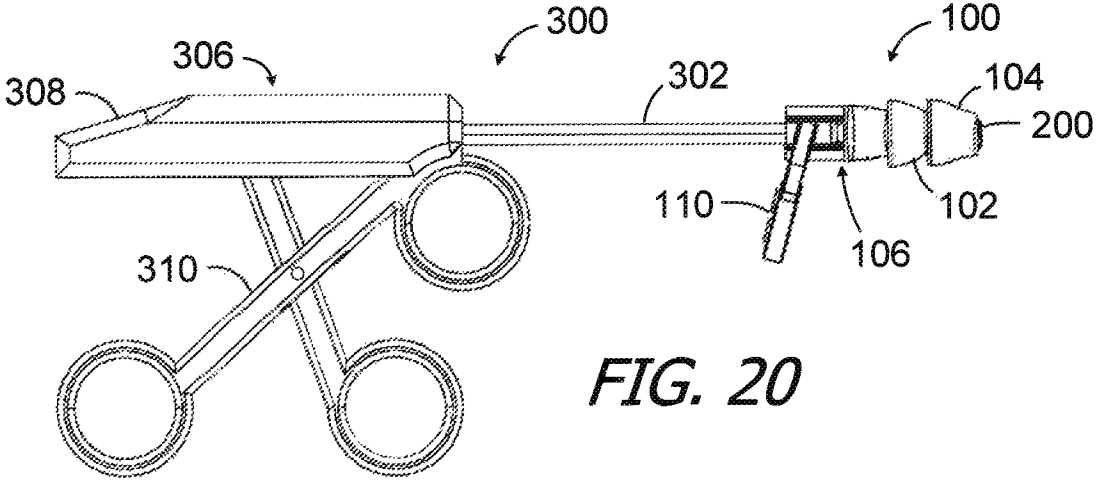
FIG. 20 is a side view showing a portion of a method in accordance with one embodiment of a present invention.

Although the present inventions are not so limited, one example of a tool that may be used to hold a hearing device core while the seal module 100 is used to mount the seals 102 and 104 onto the hearing device core and to thereafter insert the completed hearing device into the recipient's ear is the exemplary forceps 300 illustrated in FIGS. 19A and 19B. The forceps 300 includes an elongate body 302 with a pair of jaws 304 at one end and a handle 306, with a main body 308 and an actuator 310, at the other end. Referring more specifically to FIG. 19A, the actuator 310 includes a fixed arm 312 that is secured to the main body 308, a hinge pin 314, and a movable arm 316 that pivots about the hinge pin. The movable arm 316 is operably connected to the jaws 304 such that the jaws can be opened and closed by way of movement of the movable arm. Thumb, index finger and middle finger receptacles 318, 320 and 322 are also provided.

Figure 22:
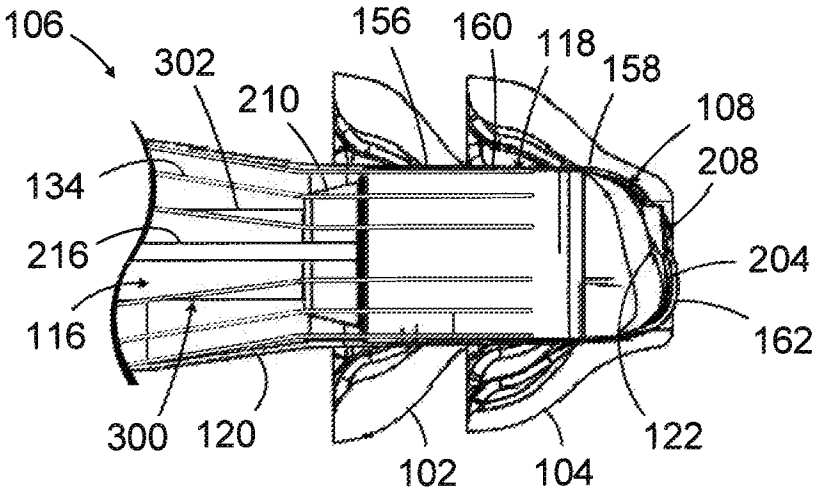
FIG. 22 is a partial section view taken along line 22-22 in FIG. 21.

One exemplary method of securing one or more seals (e.g., seals 102 and 104) to a hearing device core (e.g., core 200) with the exemplary seal module 100 and forceps 300 is illustrated in FIGS. 19A-26. Referring first to FIG. 19A, a hearing device core 200 may be secured to the forceps 300 by, for example, inserting the end of the elongate body 302 into the contamination guard 210 and clamping onto the tabs 214 (FIG. 14) with the forceps jaws 304. The seal module 100 may be rotationally and axially aligned with the hearing device core 200. The oval hearing device core 200 can then be inserted into the oval support tube lumen 134 (FIGS. 5 and 7) and moved with forceps 300 along the longitudinal axis LA in the direction of arrow A from the position illustrated in FIG. 19A to the position illustrated in FIGS. 20 and 21 while the user holds the seal module handle 110. Alternatively, the seal module 100 can be pulled in the opposite direction over the hearing device core 200 while the forceps 300 is held in place, or the seal module and hearing device core can be simultaneously moved toward one another. In any case, and as shown in FIG. 22, the seal carrier support 112 will hold the tubular seal carrier 108 open as the hearing device core 200 is pushed though the internal lumen 116 (FIG. 9). The hearing device core 200 will push open the elongate members 134 in the tapered, generally conical portion 138 of the seal carrier support 112, and will thereafter pass the medial end 162 of the tubular seal carrier 108.

Figure 21:
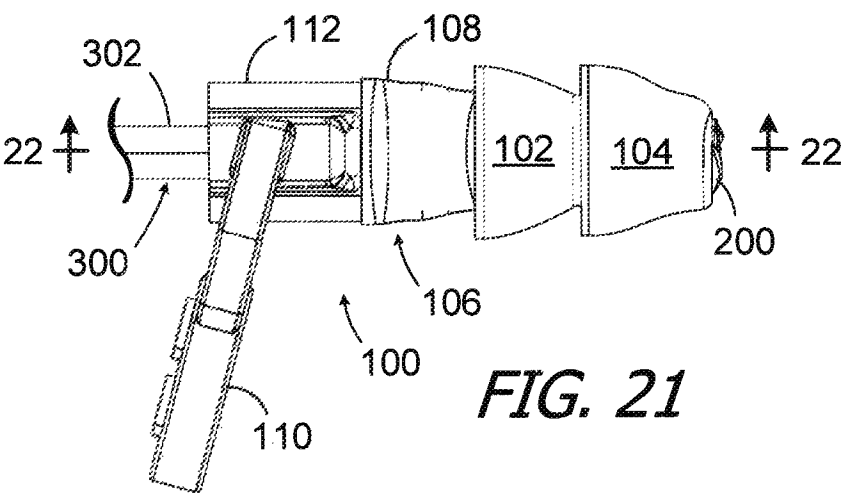
FIG. 21 is an enlarged view of a portion of FIG. 20.

The respective states of the seal module 100, hearing device core 200 and forceps 300 when the core initially reached the fully inserted position within the seal carrier 108, i.e., when the medial end 204 of the core housing 202 abuts the medial end 162 of the seal carrier seal support region 118, is shown in the FIGS. 21 and 22. The core 200 will stretch (or "stress" or "elastically deform") the central portion 160 of the tubular seal carrier seal support region 118. The resilience of the material used to form the seal support region 118, and the tackiness of the material (if tacky), creates the above-described interference fit that semi-permanently secures the seals 102 and 104 to the core 200.

Figure 23:
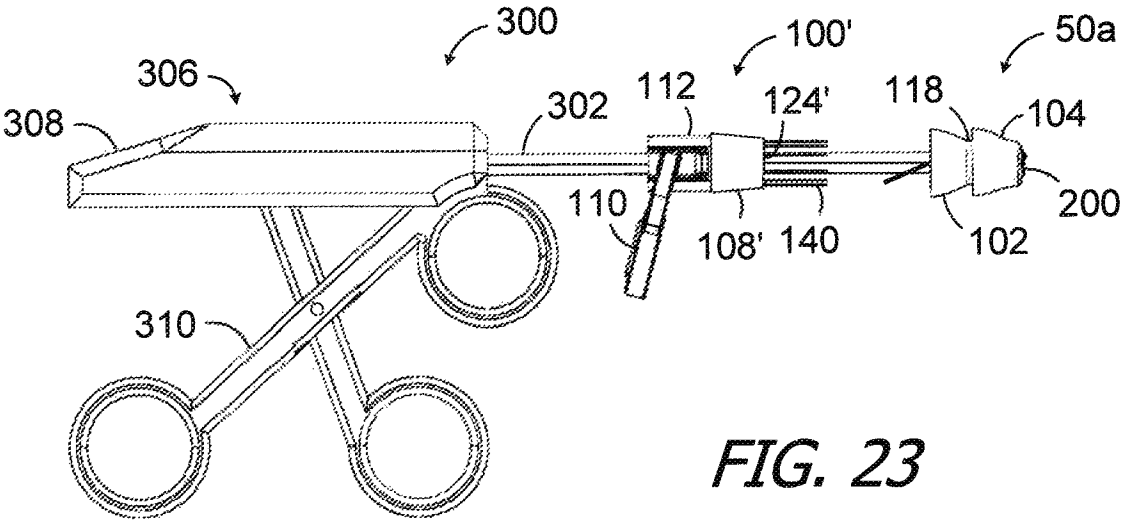
FIG. 23 is a side view showing a portion of a method in accordance with one embodiment of a present invention.

Continued movement of the seal module 100 and the core 200 relative to one another will cause weakened area 124 (FIG. 15) of the seal carrier 108 to fail, resulting in the separation of the seal support region 118 from the connector region 120 and the formation of edges 124'. The result is a hearing device 50*a* that includes the core 200, the seals 102 and 104, and the seal support region 118 of the seal carrier 108, as shown in FIGS. 23 and 24. The hearing device 50*a* may remain secured to the forceps 300 by way of the forceps jaws 304 and the core tabs 214 (FIG. 14) so that the forceps may be used to insert the hearing device 50*a* into the recipient's ear. The spent seal module 100', which consists of the seal carrier remainder 108', the handle 110, and the seal carrier support 112, also initially remains on the forceps elongate body 302. The spent seal module 100' will typically be removed from the forceps 300 prior to the insertion of the hearing device 50*a* with the forceps.

Figure 26:
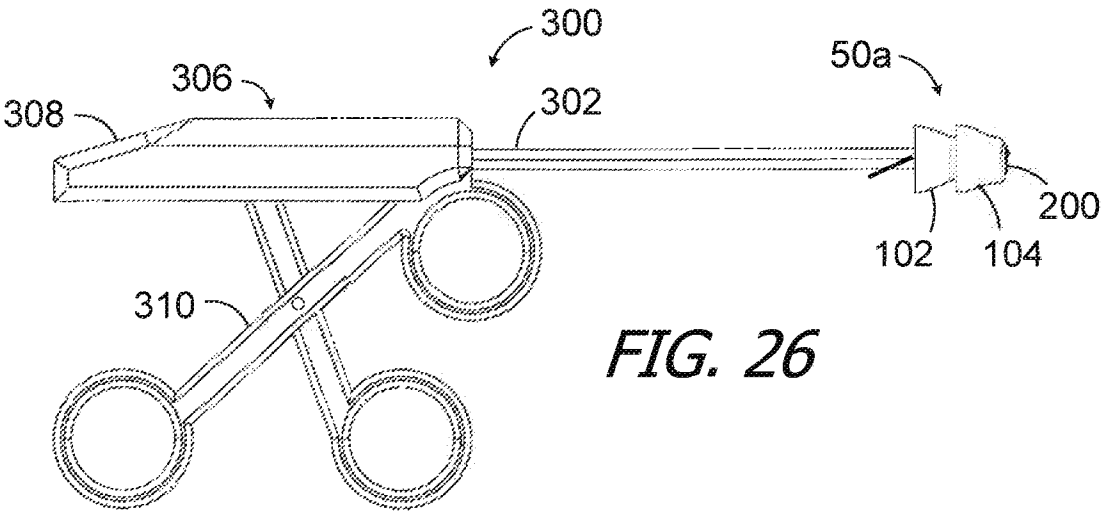
FIG. 26 is a side view showing a portion of a method in accordance with one embodiment of a present invention.

Removal of the spent seal module 100' from the forceps 300 without separating the hearing device 50*a* from the forceps 300 may be accomplished in the manner illustrated in FIG. 25A, which shows the seal carrier support 112 without the seal carrier remainder 108', elongate members 140 and sleeve 144, and in FIG. 25B. In particular, spent seal module 100' can be pulled (or pushed) off the forceps elongate body 302 by moving the spent seal module 100' in the direction of arrow B in FIG. 25A, which is transverse to the longitudinal axis LA of the support tube 132. Given the relatively large diameter of the forceps elongate body 302, as compared to the width of the tool slot 136, the support tube 132 will deform from the closed state (solid lines) where the elongate body cannot pass through the tool slot to the open state (dashed lines) and the width of the tool slot 136 has increased to an extent sufficient to permit passage of the elongate body 302 in response to the movement transverse to the longitudinal axis LA. Here, the width W2 of the tool slot 136 in an enlarged state is equal to the diameter of the elongate body 302. The seal carrier remainder 108' and the sleeve 144 will be deformed along with the support tube 132, and the weakened areas 146 and 148 will break as the forceps elongate body 302 moves out of the spent seal module lumen 134. The seal carrier remainder 108', seal carrier support 112 and sleeve 144 will then return to their initial state, albeit with broken weakened areas 146' and 148', after the spent seal module 100' has been separated from the forceps elongate body 302, as shown in FIG. 25B. Only the hearing device 50*a* will remain secured to the forceps 300, as shown in FIG. 26.

Figure 28:
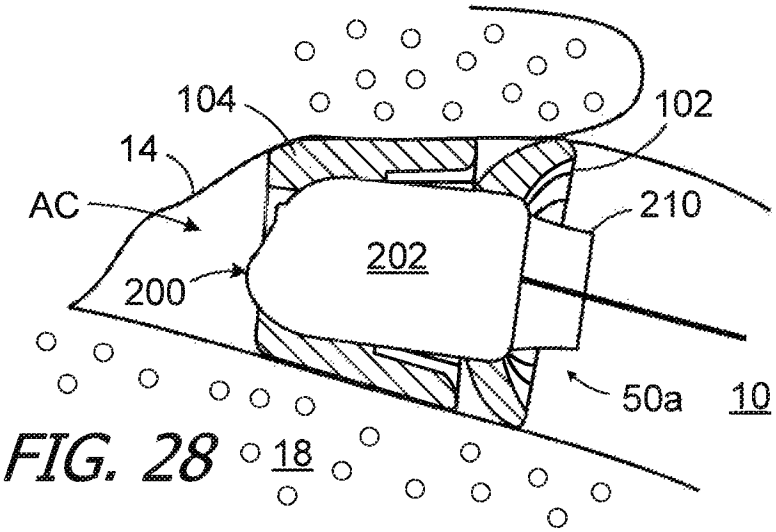
FIG. 28 is a partial section view showing a portion of a method in accordance with one embodiment of a present invention.
Figure 27:
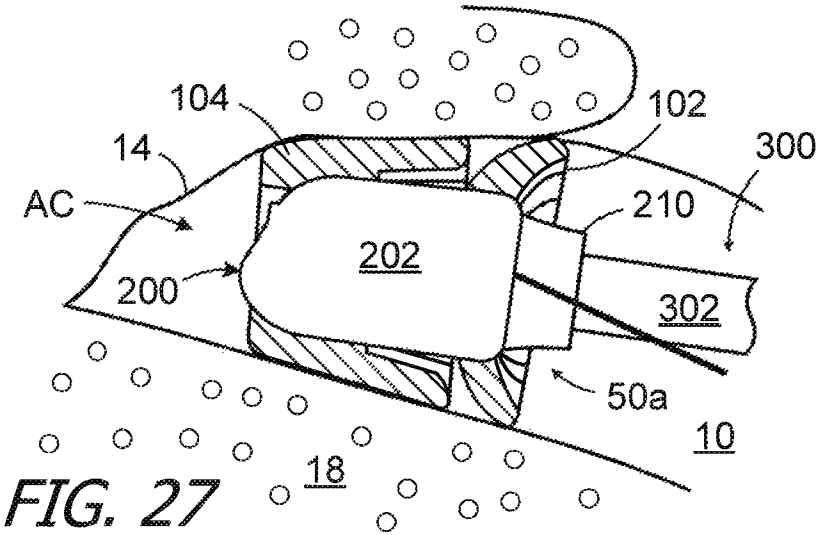
FIG. 27 is a partial section view showing a portion of a method in accordance with one embodiment of a present invention.

Next, and without separating the hearing device 50*a* from the forceps 300, the forceps may be used to insert the hearing device into the ear canal 10 in the manner illustrated in FIG. 27. The forceps 300 may then be detached from the hearing device 50*a*, e.g. by opening the forceps jaws 304, and the elongate body 302 removed from the ear, as illustrated in FIG. 28.

Although the inventions disclosed herein have been described in terms of the preferred embodiments above, numerous modifications and/or additions to the above-described preferred embodiments would be readily apparent to one skilled in the art. By way of example, but not limitation, the present hearing device seal modules may include only one seal, or may include more than two seals. The inventions include any combination of the elements from the various species and embodiments disclosed in the specification that are not already described. It is intended that the scope of the present inventions extend to all such modifications and/or additions and that the scope of the present inventions is limited solely by the claims set forth below.

We claim:

1. A hearing device seal module for use with a hearing device core and a tool, the hearing device seal module comprising:

a tubular seal carrier defining a lumen configured to receive the hearing device core and including a connector region and a resilient seal support region formed from resilient material;

a seal carrier support connected to the seal carrier connector region of the tubular seal carrier, including a support tube defining a longitudinal axis and a lumen configured to permit movement of the hearing device core and tool along the longitudinal axis, and having an open state wherein the tool is able to move out of the lumen in a direction transverse to the longitudinal axis and a closed state wherein the tool is not able to move out of the lumen in a direction transverse to the longitudinal axis; and a first seal secured to a first portion of the seal support region and extending outwardly therefrom.

2. The hearing device seal module claimed in claim 1, wherein the seal carrier support tube defines first and second longitudinal ends and includes a tool slot that extends from the first longitudinal end to the second longitudinal end.

3. The hearing device seal module claimed in claim 2, wherein the tool slot defines a length and a width; and the width is greater when the seal carrier support is in the open state than when the seal carrier support is in the closed state.

4. The hearing device seal module claimed in claim 3, wherein the support tube includes weakened areas; and portions of the support tube pivot about the support tube weakened areas as the seal carrier moves from the closed state to the open state.

5. The hearing device seal module claimed in claim 2, further comprising:

a sleeve on the support tube that covers the tool slot.

6. The hearing device seal module claimed in claim 5, wherein the sleeve includes a weakened area that is over the tool slot.

7. The hearing device seal module claimed in claim 2, wherein the tubular seal carrier defines a perimeter and includes a connector region lateral of the seal support region and a first seal carrier weakened area that extends around the perimeter and is located between the connector region and the seal support region.

8. The hearing device seal module claimed in claim 7, wherein the tubular seal carrier defines a lateral end; and the connector region includes a second seal carrier weakened area that is aligned with the tool slot and that extends from the tubular seal carrier lateral end to the first seal carrier weakened area.

9. The hearing device seal module claimed in claim 1, further comprising:

a handle extending from the seal carrier support tube.

10. The hearing device seal module claimed in claim 1, wherein the seal carrier support is configured to hold at least a portion of the resilient seal support region open during an insertion of the hearing device core.

11. The hearing device seal module claimed in claim 1, wherein the seal carrier support includes a plurality of elongate members configured to hold at least a portion of the resilient seal support region open during an insertion of the hearing device core.

12. The hearing device seal module claimed in claim 1, wherein the tubular seal carrier defines a medial-lateral axis;

the resilient seal support region includes a first portion defining a first portion perimeter in a plane perpendicular to the medial-lateral axis and a second portion, lateral of the first portion, defining a second portion perimeter in a plane perpendicular to the medial-lateral axis that is less than the first portion perimeter when the resilient seal support region is in an unstressed state; and the first seal is on the first portion of the resilient seal support region.

13. The hearing device seal module claimed in claim 1, further comprising:

a second seal secured to a second portion of the seal support region and extending outwardly therefrom.

14. A method, comprising the steps of:

securing a hearing device core to a tool;

forming a hearing device by positioning a seal on the hearing device core with a hearing device seal module while the hearing device core is secured to the tool and in such a manner that a spent hearing device seal module remains on the tool after the hearing device is formed; and without separating the hearing device from the tool, separating the spent hearing device seal module from the tool.

15. The method claimed in claim 14, wherein the tool comprises a forceps.

16. The method claimed in claim 14, wherein the hearing device seal module comprises a tubular seal carrier defining a lumen configured to receive the hearing device core and including a connector region and a resilient seal support region formed from resilient material on which the seal is supported, and a seal carrier support connected to the seal carrier connector region of the tubular seal carrier and including a support tube defining a longitudinal axis and a lumen configured to permit movement of the hearing device core and tool along the longitudinal axis.

17. The method claimed in claim 16, wherein the spent hearing device seal module includes the seal carrier support and a portion of the tubular seal carrier.

18. The method claimed in claim 16, wherein the seal carrier support tube defines first and second longitudinal ends and includes a tool slot that extends from the first longitudinal end to the second longitudinal end; and separating the spent hearing device seal module from the tool comprises moving a portion of the tool through the tool slot.

19. The method claimed in claim 18, wherein the tool slot defines a length and a width; and moving a portion of the tool through the tool slot comprises increasing the width of the tool slot as the portion of the tool moves through the tool slot.

20. The method claimed in claim 18, wherein hearing device seal module further comprises a sleeve on the support tube that covers the tool slot; and moving a portion of the tool through the tool slot comprises breaking a portion of the cover.

* * * * *